US006490892B1

(12) United States Patent
Freiman

(10) Patent No.: US 6,490,892 B1
(45) Date of Patent: Dec. 10, 2002

(54) PADLOCK DEVICE

(75) Inventor: Glen Freiman, Madison, CT (US)

(73) Assignee: Highfield Manufacturing Company, Bridgeport, CT (US)

( * ) Notice: Subject to any disclaimer, the term of this patent is extended or adjusted under 35 U.S.C. 154(b) by 0 days.

(21) Appl. No.: 09/507,975

(22) Filed: Feb. 22, 2000

(51) Int. Cl.[7] ..... E05B 67/36
(52) U.S. Cl. ..... 70/34; 70/2; 70/159
(58) Field of Search ..... 70/2, 34, 63, 158–163

(56) References Cited

U.S. PATENT DOCUMENTS 4,107,959 A * 8/1978 Skarzynski et al. ..... 70/159
4,120,182 A * 10/1978 Michelman et al. ..... 70/34 X
4,313,319 A * 2/1982 Haus, Jr. et al. ..... 70/34
4,474,041 A * 10/1984 Finck, Jr. ..... 70/159
4,551,999 A * 11/1985 Guiler ..... 70/159
4,699,408 A * 10/1987 Kesselman ..... 70/159 X
4,793,164 A * 12/1988 Sloop, Sr. ..... 70/34 X
5,007,258 A * 4/1991 Mahaney ..... 70/34 X
5,127,244 A * 7/1992 Myers ..... 70/2
5,442,941 A * 8/1995 Kahonen et al. ..... 70/34
5,819,889 A * 10/1998 Shieh ..... 70/34 X
5,870,911 A * 2/1999 DeWalch ..... 70/159

* cited by examiner

*Primary Examiner*—Suzanne Barrett
(74) *Attorney, Agent, or Firm*—Jules Jay Morris; David Barron; Jonathan Wainer

(57) ABSTRACT

A barrel lock padlock is provided which can be used to engage the hasp-and-staple fitted to an enclosure such as a gas or electricity meter box. The housing of the barrel lock has a slot into which the staple can be passed to align with the bore in the housing in which the plunger of the barrel lock is movable, so that when the plunger is moved to the locking position by its spring it passes through the staple to lock the box. A key is passed through a key hole in a cap of the lock to engage the plunger and retract it, allowing the padlock to be removed from the staple.

12 Claims, 3 Drawing Sheets

PADLOCK DEVICE

BACKGROUND OF THE INVENTION

1. Technical Field

This invention relates to a padlock and to a locking assembly including said padlock in which the padlock is of the so-called barrel lock type, in which locking is effected by a plunger which is spring biased to the locking position and may be withdrawn to an unlocking position against the action of the spring by use of a special key.

2. Description of the Prior Art

Barrel locks are favored as a means of securing gas and electricity meters because the lock can be installed and locked without needing to use the key, leaving intact a seal over the keyhole. Only authorized persons in possession of the key may thereafter unlock the barrel lock.

In prior art devices the plunger of a barrel lock may displace balls outwardly of the lock housing or, as exemplified in U.S. Pat. No. 4,474,041, the plunger may, in the locking position, engage and prevent relative axial movement of a stud which projects from the enclosure to be locked and which passes through a bore in the lock housing which is transverse to the bore in which the plunger is movable.

Many utility meter boxes are provided with a hasp-and-staple whereby the box may be padlocked. The present invention proceeds from the realization that a barrel lock may be adapted for use as a padlock, thereby dispensing with the need for a stud assembly projecting from the meter box. As illustrated in FIG. 3 of the Drawings of the said U.S. Pat. No. 4,474,041 the provision of the stud requires that a special opening be drilled in a side wall of the box, the insertion of a bolt through this opening onto which the stud is threaded and the provision of a locking flange and backing plate. In addition to the labor involved in installing it the stud assembly represents a high proportion of the cost of manufacturing the barrel lock assembly.

SUMMARY OF THE INVENTION

A principal object of the present invention is to provide a padlock of the barrel lock type which will be cheaper to manufacture and easier to install than barrel locks of the kind exemplified in U.S. Pat. No. 4,474,041.

In accordance with one aspect of the present invention there is provided a padlock comprising a housing, a bore in the housing, a plunger movable axially of the bore, spring means biasing the plunger toward one end of the bore, a cap closing the other end of the bore, key engagement means at the end of the plunger nearer the cap, a key hole in the cap aligned with said key engagement means and a slot in said housing transverse to and intersecting said bore, the slot being adapted to receive the staple of a hasp-and-staple fastening whereby the plunger may pass through said staple to lock an enclosure fitted with said hasp-and-staple fastening.

In accordance with another aspect of the present invention there is provided the combination of a padlock as defined in the immediately preceding paragraph and an enclosure having a hinged lid and provided with a hasp-and-staple fastening, wherein the hasp is a hasp projecting from a side wall of the enclosure and the staple is pivotable at one end relative to the lid whereby the other end of the staple may be swung through or withdrawn from said hasp, said other end of the staple having an aperture which, when said other end of the staple is inserted in said slot of said padlock, may be coaxially aligned with said bore of said padlock whereby said plunger may pass through said aperture of the staple to lock the lid of the enclosure.

The staple may be fabricated from sheet metal to be generally J-shaped and the slot in the padlock may be parallel-sided to receive the apertured end of the staple as a sliding fit.

The padlock cap is preferably in the form of a body from one end of which projects a reduced diameter spigot. An end of the housing comprises a bore of enlarged diameter to receive said spigot, the housing body having a blind bore which, in the assembled condition of the cap and housing, is axially aligned with the bore in the housing. The key hole is formed at the blind end of the bore in the cap and a compressed spring is trapped in the assembled cap and housing between the plunger and the blind bore in the cap body.

The body of the cap may be surrounded by a metal casing which extends beyond the end of the body remote from the spigot to form a crown for the body, said crown having slits through which a seal may be passed to cover the key hole.

The housing is preferably formed with a further bore transverse to the plunger bore and on the side of the slot nearer the cap through which further bore a plunger-retention member may be passed to hold the plunger in the unlocked position against the action of the spring means.

Said further bore is preferably a blind bore which is intersected by the plunger bore intermediate the ends of the further bore.

Said bore in the housing in which the plunger is movable is preferably a blind bore which is intersected by said slot intermediate the ends of the blind bore.

BRIEF DESCRIPTION OF THE DRAWINGS

Reference is made to the accompanying drawings in which like reference numerals refer to the same elements throughout the different views. The drawings are not being made to scale, but rather disclosing an illustrative embodiment of the invention.

Preferred embodiments of the invention will now be described with reference to the accompanying drawings, in which.

DETAILED DESCRIPTION OF THE INVENTION

Figure 1:
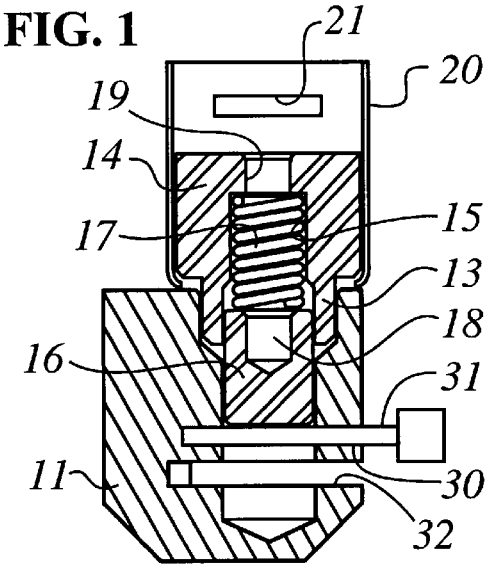
FIG. 1 is a sectional elevation of a padlock in accordance with the invention in an unlocked condition.

The padlock 10 illustrated in FIGS. 1, 2, 9 and 10 comprises a lock housing 11 formed with a blind bore 12 opening to the top of the housing. Near to its upper end the bore 12 is of enlarged diameter to receive a spigot 13 which projects from the lower end of a body 14 constituting a cap. The body 14 is also formed with a blind bore 15 and in the assembled condition of the cap 14 and lock housing 11 the blind bores 12 and 15 are coaxial. A plunger 16 is movable axially of the blind bore 12 and a compression spring 17 is in compression between the top of plunger 16 and the blind end of bore 15, so that it permanently biases the plunger toward the blind end of bore 12. After insertion of the plunger 16 and spring 17 into the aligned bores 12 and 15 the cap 14 is press fitted to the lock housing 11.

The top of the barrel lock plunger 16 is formed with a key-engaging socket formation 18 and the blind end of bore 15 is formed with a key hole 19 aligned with the key socket 18 whereby a special key with spreadable end members (not shown) may be inserted through key hole 19. The key engages plunger 16 at socket 18 and is used to retract it against the action of spring 17 to the unlocked position illustrated in FIG. 1.

The body 14 of the cap is surrounded by a metal casing 20 which extends beyond the end of the body 14 remote from the spigot 13 to provide a crown for the cap. Opposed slits in the crown, one of which is visible at 21, can be used in known manner to pass a wire seal (not shown) through the slits across the top of the key hole 19 so that with the seal intact a key cannot enter the key hole 19.

The padlock 10 is for use in securing an enclosure having a hasp-and-staple fastening. The housing 11 of the padlock having a slot 22 transverse to and intermediate the ends of the bore 12 into which the staple 27 may be inserted to be engaged by the plunger 16.

Figure 2:
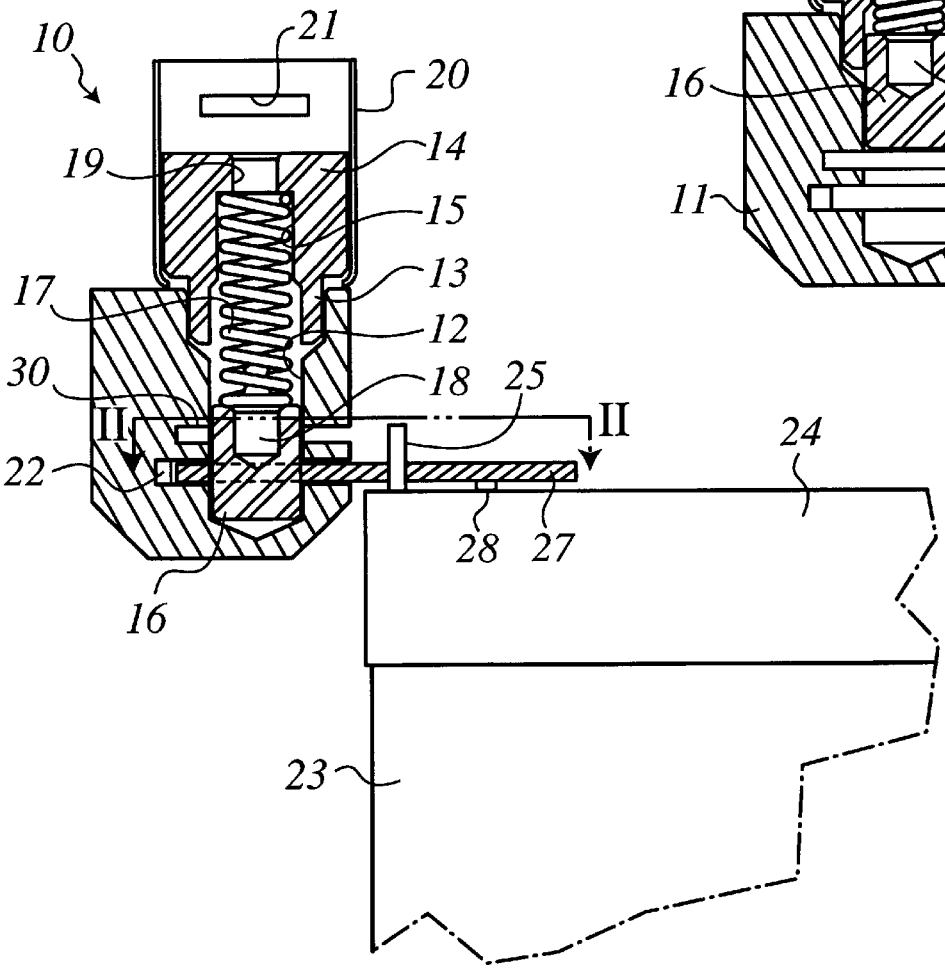
FIG. 2 illustrates the padlock of FIG. 1 in a locked condition, engaging the staple of a hasp-and-staple fastening fitted to the hinged lid of a meter box.
Figure 3:
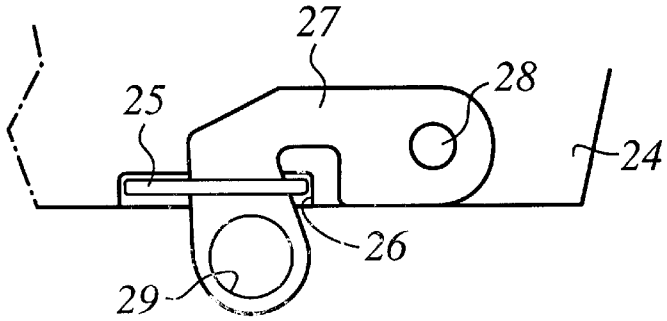
FIG. 3 is a view taken on the line II—II of FIG. 2 with the padlock removed.

Part of an enclosure to be secured is illustrated in FIGS. 2 and 3 and takes the form of a utility meter box 23 having a hinged lid 24. A hasp 25 is in the form of a hasp which projects from the side of the box remote from the hinge of the lid to pass through a recess 26 in the lid. A J-shaped staple 27 is stamped or otherwise fabricated from sheet metal. The staple or lever 27 is pivoted at one end at post 28 which is attached to the lid 24 so that its other end, may be swung through or withdrawn from the hasp 25. With the end of the staple 27 having the opening 29 passed first through the hasp 25 and then into the slot 22 in the padlock housing 11 the opening 29 is aligned with the bore 12, permitting the plunger 16 to pass through the opening 29 and thus prevent withdrawal of the staple 27 from the padlock. The slot 22 is parallel-sided and accepts the staple 27 as a sliding fit. Once the staple or lever 27 is firmly engaged by plunger 16, the box lid 24 is secured and can not be opened.

On the side of the slot 22 nearer the cap 14 the plunger bore 12 is also intersected by a small-diameter, blind bore 30 into which a preset pin 31 may be inserted to retain the plunger 16 in the unlocked position in which it is shown in FIG. 1 against the action of spring 17.

In use, padlock 10 may be supplied with pin 31 in bore 30 and an intact seal (not shown) passing through the slits 21 and covering the keyhole 19. The installer does not have to be provided with a key but may pass the staple 27 of a meter box into the slot 22 of the padlock and then withdraw the pin 31 so that the meter box is locked. Thereafter the meter box can be opened only by someone in possession of a key, who will first break the seal and then retract the plunger 16 using the key until the staple 27 can be withdrawn from the slot 22 in the padlock. The staple 27 can now be swung out the hasp 25, enabling the lid of the box to be opened.

The modified padlocks of FIGS. 4–8 have most features in common with that of FIGS. 1 and 2 and like parts have like reference numerals. The differences are as follows.

Figure 4:
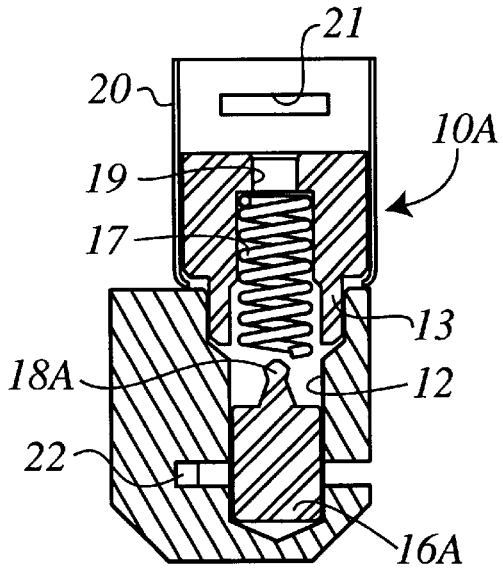
FIGS. 4–8 are each views similar to FIG. 1 of additional embodiments of the padlock of the present invention.
Figure 5:
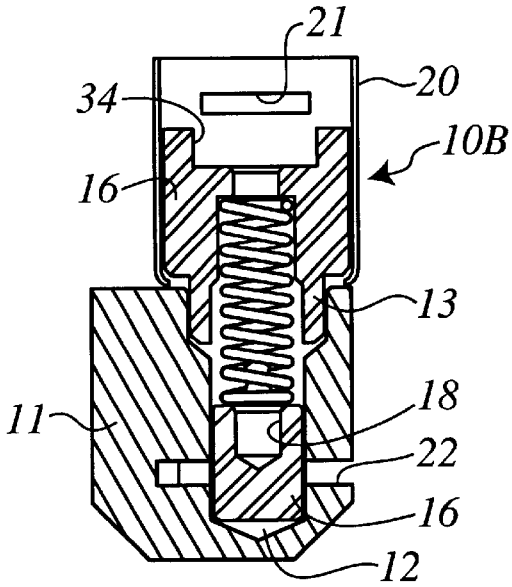
Figure 6:
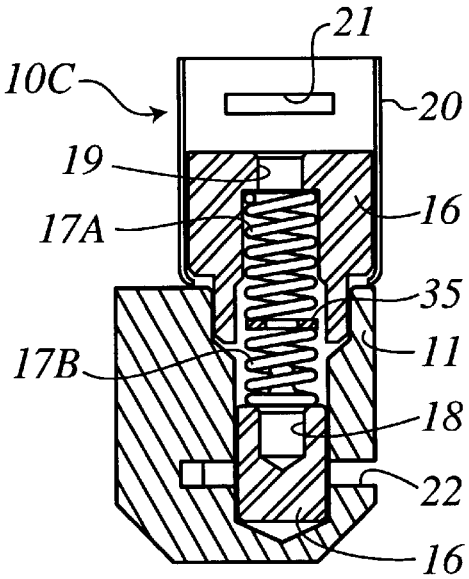
Figure 7:
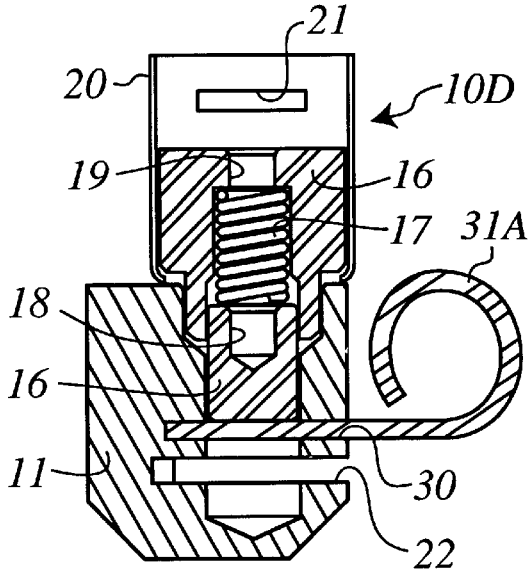
Figure 8:
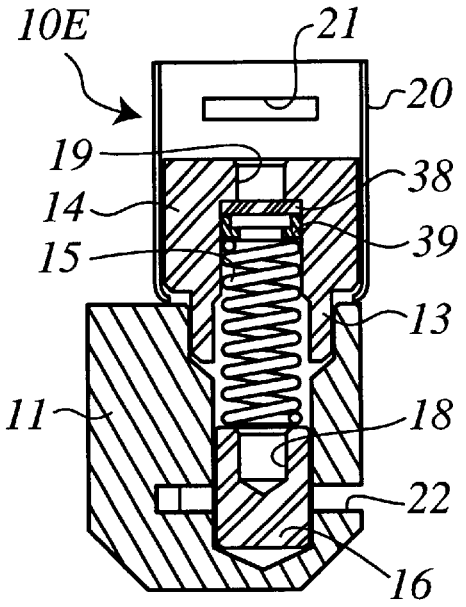

The padlocks 10A, 10B and 10C of FIGS. 4–6 and the padlock 10E of FIG. 8 each lack any plunger retention means such as the pin 31 insertable in a bore 30 in FIG. 1. The installer must be in possession of a key (not shown) to unlock these padlocks. In the embodiment of FIG. 7 the pin 31 is replaced by a strip 31A with a curled end to assist grasping the retention means. The strip is grabbed by the installe(r) and withdrawn after the lock is in position.

The plunger 16A of the padlock 10A of FIG. 4 has, in place of the hollow key engaging formation 18, which is engaged by an expandable key, a projection 18A to be engaged by a contracting collet key (not shown) that can be used to grab the projection 18A to retract the plunger 16.

In FIG. 5 the top surface of the body 14 of the cap is formed with a recess 34. This may be formed with a complex shape to be fitted by a cooperating part of the key (not shown). If the key cannot reach the key engaging cup 18 in the plunger 16 unless it fits the recess 34 this provides added security. This addition allows the use of complex keys that are less easily circumvented to allow access to the utility box 23.

In the padlock 10C of FIG. 6 the single spring 17 of other embodiments is replaced by two compression springs 17A and 17B holding between them a washer-like element 35. The aperture of this element 35 may also have a complex shape; which must be fitted by the key (not shown) to allow the key to pass through and engage the recess 18 of the plunger 16. This again allows the use of a complex key for added security and in this case, the key engaging aperture of element 35 is obscured from view making it more difficult to counterfeit an operable key.

In the padlock 10E of FIG. 8, which otherwise resembles the padlock of FIG. 1, a resilient weather seal 38 having a seal cup 39 is held by the spring 17 against the blind end of bore 15 to inhibit the ingress of water and dirt.

Such resilient weather seals are required as the locks disclosed are intended for outside usage and may sit exposed to the elements for months or years. External debris must therefore by excluded to avoid their clogging of the keyway formed by the spring. Such debris could make it difficult to engage the key in the key socket 18 and withdraw the plunger.

Figure 9:
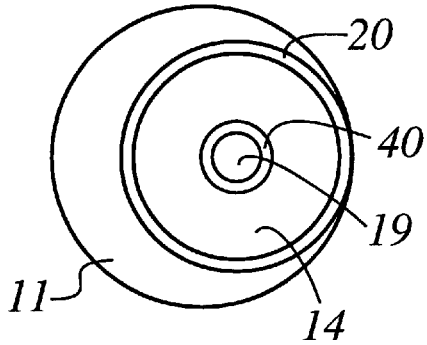
FIG. 9 is a top view of a padlock of the present invention.
Figure 10:
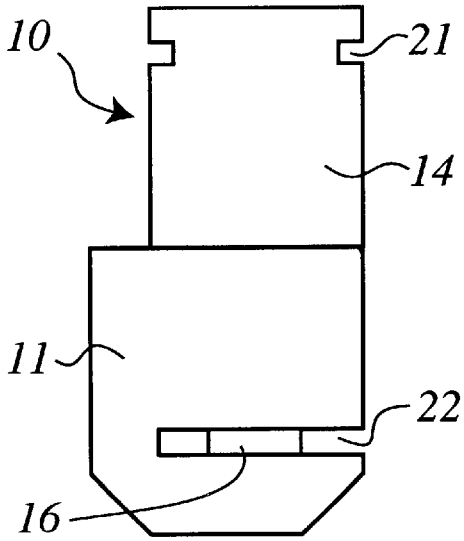
FIG. 10 is a side view of the padlock of FIG. 1.

FIG. 9 is a top view of the present invention, which is appropriate for the entire embodiment discussed above. The cap 14 is offset in circular base 11. The chamfered key entryway 40 guides the key to keyhole 19. Casing 20 surrounds the key entrance and is provided with slots 21 (FIG. 10) for the keyway seal (not shown).

Base 11 is offset relative to the cap 14 and provides, as noted above, the capture bore for the plunger 16 and the slotted entrance way 22 for the cover lever staple 27. Sufficient clearance is provided for engagement of the locking opening 29 without the padlock interfering with the utility box 24. It is advantageous, however, for the lock to be closely adjacent to the utility box to make it less susceptible to vandalism or accidental damage.

While the invention has been shown and described in reference to the preferred embodiments, it will be understood by those skilled in the art that various modifications may be made to the device without deporting from the scope of the invention as defined in the appended claims.

I claim:

1. A padlock comprising a housing, a bore in the housing, a plunger movable axially of the bore, spring means biasing the plunger toward one end of the bore, a cap closing the other end of the bore, key engagement means at the end of the plunger nearer the cap, a key hole in the cap aligned with said key engagement means and a slot in said housing transverse to and intersecting said bore, the slot being adapted to receive the staple of a hasp-and-staple fastening whereby the plunger may pass through said staple to lock an enclosure fitted with said hasp-and-staple fastening wherein the housing is formed with a further bore transverse to the plunger bore and on the side of the slot nearer the cap through which further bore a plunger-retention member may be passed to hold the plunger in the unlocked position against the action of the spring means.

2. The combination of a padlock as claimed in claim 1 and an enclosure having a hinged lid and provided with a hasp-and-staple fastening, wherein the hasp is a hasp upstanding from a side wall of the enclosure and the staple is pivotable at one end relative to the lid whereby the other end of the staple may be swung through or withdrawn from said hasp, said other end of the staple having an aperture which, when said other end of the staple is inserted in said slot of said padlock, may be coaxially aligned with said bore of said padlock whereby said plunger may pass through said aperture of the staple to lock the lid of the enclosure.

3. The combination claimed in claim 2, wherein the staple is fabricated from sheet metal to be generally J-shaped and wherein the slot in the padlock is parallel-sided to receive the apertured end of the staple as a sliding fit.

4. A padlock as claimed in claim 1, wherein the cap is in the form of a body from one end of which a spigot projects and wherein said other end of the bore of the housing is of enlarged diameter to receive said spigot, the body having a blind bore which, in the assembled condition of the cap and housing is axially aligned with the bore in the housing, said key hole being formed at the blind end of the bore in the cap and said spring means being a compression spring which in the assembled condition of the cap and housing is trapped between the plunger and the blind bore in the cap body.

5. A padlock as claimed in claim 4, wherein the body of the cap is surrounded by a metal casing which extends beyond the end of the body remote from the spigot to form a crown for the body, said crown having slits through which a seal may be passed to cover the key hole.

6. A padlock as claimed in claim 1 wherein said further bore is a blind bore which is intersected by the plunger bore intermediate the ends of the further bore.

7. A padlock as claimed in claim 1 wherein said bore in the housing in which the plunger is movable is a blind bore which is intersected by said slot intermediate the ends of said bore.

8. The key operated lock housing and lock assembly of claim 1 wherein said staple comprises a moveable member of a hinged box lid of a box, said moveable member arranged to engage a hasp projecting from said box such that when engaged said hinged box lid is locked in position and may not be opened.

9. The key operated lock housing and lock assembly of claim 2 wherein said lock assembly secures said staple in engagement with said hasp.

10. A padlock as claimed in claim 1 further comprising a seal member interspaced between said housing and said spring means at the end of said bore nearest said cap, said seal member for preventing the entry of dirt and debris into said padlock.

11. A padlock comprising a padlock housing, a bore in the padlock housing, a plunger movable axially of the bore, a spring biasing the plunger toward one end of the bore, a cap closing the other end of the bore, key engagement means at the end of the plunger nearer the cap, a key hole in the cap aligned with said key engagement means and a slot in said padlock housing transverse to and intersecting said bore, the slot being adapted to receive the staple of a hasp-and-staple fastening whereby the plunger may pass through said staple to lock an enclosure fitted with said hasp-and-staple fastening wherein the padlock housing is formed with a further blind bore which is intersected by the plunger bore intermediate the ends of the further bore and wherein the said blind bore is positioned between said slot and said cap so that the a plunger-retention member may be placed in the blind bore to hold the plunger in the unlocked position against the action of the spring means.

12. A padlock as claimed in claim 11 further comprising a seal member interspaced between said padlock housing and said spring means at the end of said bore nearest said cap, said seal member for preventing the entry of dirt and debris into said padlock.

* * * * *